US006659412B1

(12) United States Patent
Roach

(10) Patent No.: US 6,659,412 B1
(45) Date of Patent: Dec. 9, 2003

(54) ARTICLE HOLDER ADAPTED FOR BEING SUPPORTED BY A FENCE

(76) Inventor: Larry C. Roach, 3 Okahatchee Cir., Fort Walton Beach, FL (US) 32548

( * ) Notice: Subject to any disclaimer, the term of this patent is extended or adjusted under 35 U.S.C. 154(b) by 0 days.

(21) Appl. No.: 10/102,370

(22) Filed: Mar. 19, 2002

(51) Int. Cl.[7] ..... E04G 5/06

(52) U.S. Cl. ..... 248/215; 248/304; 248/340; 211/113

(58) Field of Search ..... 248/215, 304, 248/307, 339, 340, 89; 211/113, 118, 119, 116, 117, 85.7, 119.004; 223/88; D6/552

(56) References Cited

U.S. PATENT DOCUMENTS

| | | | | | |
|---|---|---|---|---|---|
| 811,375 | A | * | 1/1906 | Clark | 211/104 |
| 835,464 | A | * | 11/1906 | Palmenberg | 223/88 |
| 1,388,799 | A | * | 8/1921 | Christensen | 172/674 |
| 2,633,998 | A | * | 4/1953 | Derman | 211/104 |
| 3,972,499 | A | | 8/1976 | Simmons | |
| 3,978,988 | A | * | 9/1976 | Friedeberg | 211/113 |
| 4,376,502 | A | * | 3/1983 | Cohen | 224/411 |
| D287,550 | S | * | 1/1987 | Tocci | D6/320 |
| 4,953,817 | A | | 9/1990 | Mosteller | |
| 4,986,427 | A | * | 1/1991 | Law et al. | 211/64 |
| 5,457,911 | A | | 10/1995 | Vollink | |
| 5,487,475 | A | * | 1/1996 | Knee | 211/70.8 |
| 5,582,377 | A | | 12/1996 | Quesada | |
| 5,626,244 | A | * | 5/1997 | Mesna et al. | 211/60.1 |
| 5,711,433 | A | | 1/1998 | Smith | |
| 5,711,502 | A | | 1/1998 | Emalfarb et al. | |
| 5,738,319 | A | | 4/1998 | Grassi | |
| 5,836,460 | A | * | 11/1998 | Brown et al. | 211/74 |
| 5,950,337 | A | * | 9/1999 | Lehrman | 38/103 |
| 6,003,824 | A | | 12/1999 | Peterson et al. | |
| 6,216,886 | B1 | | 4/2001 | Considine | |
| 6,293,328 | B1 | * | 9/2001 | Fremont | 160/135 |
| 6,340,091 | B1 | * | 1/2002 | Romeo et al. | 211/59.2 |
| 6,533,132 | B1 | * | 3/2003 | Weisenburger | 211/70.8 |

* cited by examiner

*Primary Examiner*—Korie Chan
(74) *Attorney, Agent, or Firm*—John D. Gugliotta; Olen L. York, III

(57) ABSTRACT

An apparatus is provided designed to hold extension ladders to fences for storing purposes. A wood or plastic base or back structure that is hung from the top rail of the fence by two large rafter-type hooks. A ladder hook is then mounted to the face of the base or back structure to support the ladder. Other applications are envisioned as well such as hanging hoses, potted plants, gardening tools and supplies, pool tools or toys, and the like.

9 Claims, 3 Drawing Sheets

ARTICLE HOLDER ADAPTED FOR BEING SUPPORTED BY A FENCE

RELATED APPLICATIONS

The present invention was first described in Disclosure Document Registration filed on 499,891 on Sep. 14, 2001 under 35 U.S.C. §122 and 37 C.F.R. §1.14. There are no previously filed, nor currently any co-pending applications, anywhere in the world.

BACKGROUND OF THE INVENTION

1. Field of the Invention

The present invention relates generally to include hanging type organizing devices and, more particularly, to an article holder particularly adapted for being supported by a fence.

2. Description of the Related Art

There is a seemingly endless list of activities performed at home that require the use of a ladder in order to allow its user to gain access to areas that otherwise would be inaccessible. However, as handy as ladders are, they are not without their disadvantages. Perhaps the biggest disadvantage is that they require a large storage area that most people do not have in their homes or garages. As a result, fences, particularly chain link fences, become a popular spot to hang a ladder. Various methods such as hooks, straps, cords, wire and the like are used but are often not easy to access, and may place stress on the fence fabric, possibly causing damage. This same problem exists with other items such as hoses, pool tools and toys, and the like commonly found in backyards.

A search of the prior art did not disclose any patents that read directly on the claims of the instant invention; however, the following references were considered related.

U.S. Pat. No. 6,216,886, issued in the name of Clifford J. Considine, describes a hanger adapted to attach to a post U.S. Pat. No. 6,003,824, issued in the name of Robert E. Peterson and George W. Peterson, describes a method of hanging a clay flowerpot U.S. Pat. No. 5,738,319, issued in the name of Walter L. Grassi, describes an adjustable planter box hanger U.S. Pat. No. 5,711,502, issued in the name of Seymour Emalfarb and Bradley S. Emalfarb, describes an article hanger to be connected to an upright support.

U.S. Pat. No. 5,711,433, issued in the name of Carson Kelly Smith, describes a supporting bracket to support two planting pots U.S. Pat. No. 5,582,377, issued in the name of Genaro E. Quesada, describes a device for hanging articles from a chain link fence U.S. Pat. No. 5,457,911, issued in the name of Dan H. Vollink, describes a fence mounted hanger U.S. Pat. No. 4,953,817, issued in the name of Peter Mosteller, describes a hanger adapted to connect or attach items to a chain link fence U.S. Pat. No. 3,972,499, issued in the name of George H. Simmons, describes a hanger which can be attached to a diagonal rod or wire Consequently, there is a need for a means by which ladders and similar objects can be easily hung from fences without the disadvantages as described above

SUMMARY OF THE INVENTION

It is therefore an object of the present invention to provide an improved hanging type organizing device.

It is a feature of the present invention to provide an improved article holder particularly adapted for being supported by a fence.

Briefly described according to one embodiment of the present invention, an apparatus is provided designed to hold extension ladders to fences for storing purposes. The invention consists primarily of a wood or plastic base or back structure that is hung from the top rail of the fence by two large rafter-type hooks. A conventional ladder hook is then mounted to the face of the base or back structure to support the ladder. The invention would be used in pairs. The invention is also envisioned to have other applications as well such as hanging hoses, potted plants, gardening tools and supplies, pool tools or toys, and the like. envisioned that other smaller versions of the invention could be used for similar applications such as on the side bed rail of a hospital bed for holding personal items or medical supplies, or on the inside of a car door for holding fast food or electronic devices.

The use of the present invention allows storage of awkward and unwieldy items on outdoor fences in a manner which is not only quick, easy and effective, but does not damage the fence as well.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the FIGS.

1. Detailed Description of the FIGS.

Figure 1:
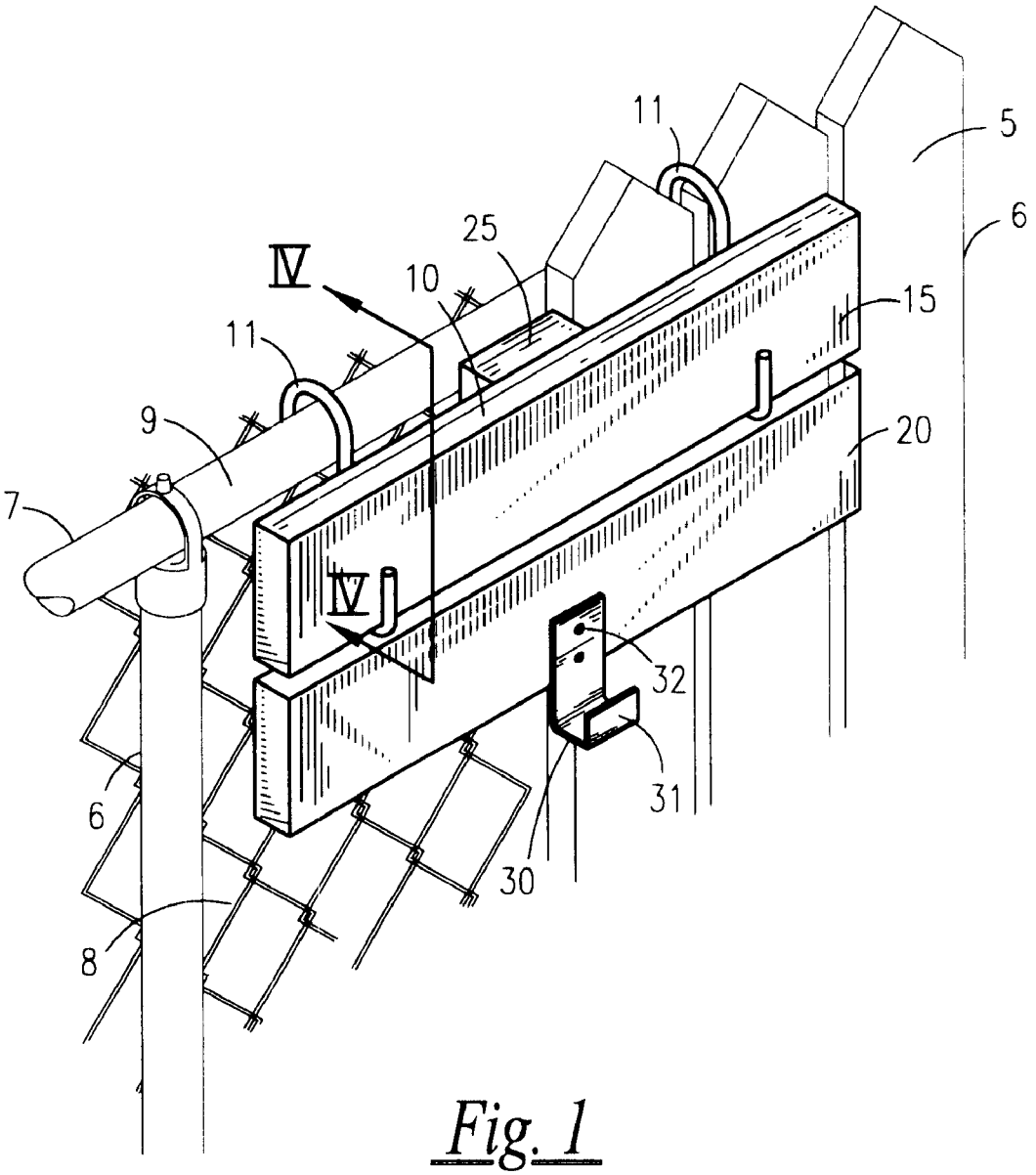
FIG. 1 is a perspective view of an article holder adapted for being supported by a fence according to the preferred embodiment of the present invention.

Referring now to FIG. 1, an article holder particularly adapted for being supported by a fence 10 shown, according to the preferred embodiment of the present invention, is shown as an invention for holding heavy articles to a fence 5, which fence 5 has vertical rails 6 or vertical rails 6 connected by a chain link, lattice 8 and adjoined by a top horizontal rail 7. The article holder particularly adapted for being supported by a fence 10 shown in FIG. 1 comprises left and right hanging support brackets 11, top and bottom horizontal supports 15,20 a vertical support 25 and an article holder 30.

Figure 4:
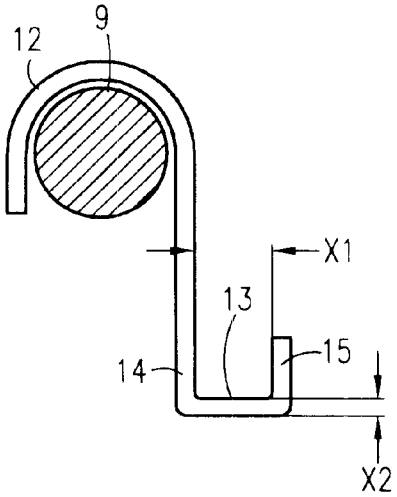
FIG. 4 is a partial cross sectional elevational view taken along line IV—IV of FIG. 1.

Left and right hanging support brackets 11 are substantially identical one to the other. For the sake of convenience, generally only one hanging support bracket 11 will be described in the following description. Each hanging support bracket 11 shown in FIG. 4 has an inverted U shape support structure 12 engaging top portion for engaging the top horizontal surface of the fence 9, and terminate in a sharp bent U-shaped seat 13 with the legs 14, 15 defining the effective width of the U-shaped seat 13. The effective width of the U-shaped seat is identified as X1. In a preferred form the effective width of the U-shaped seat 13 accommodates a nominal two inch lumber width.

Figure 6:
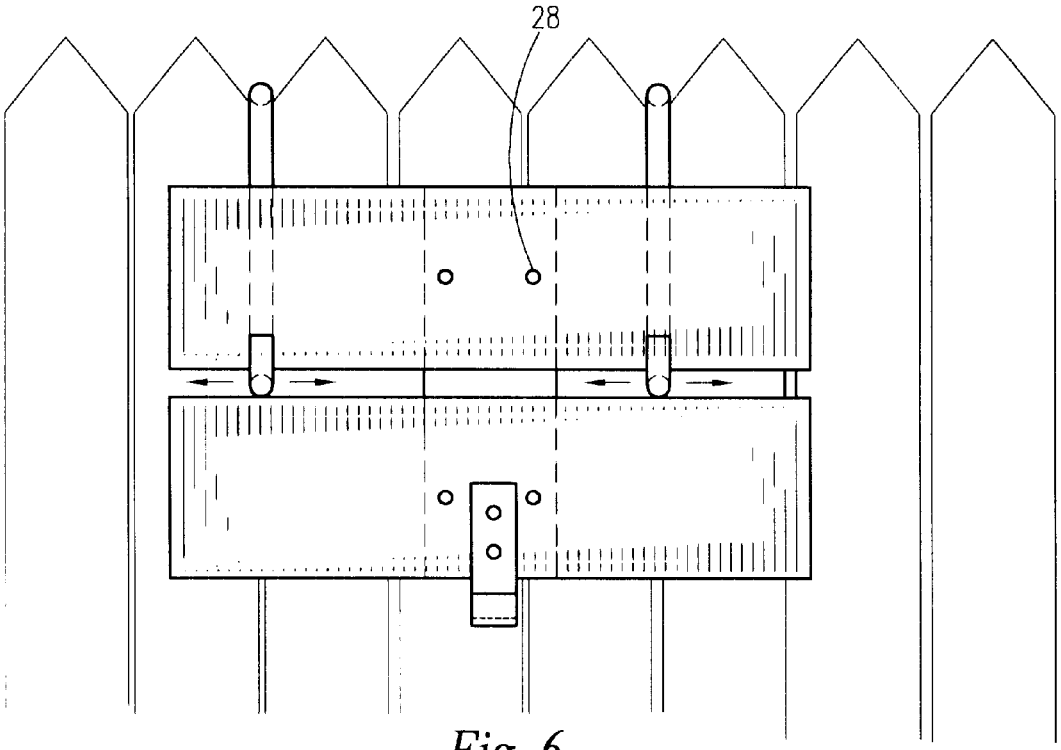
FIG. 6 is a front elevational view of the preferred embodiment of the present invention.

The top and bottom horizontal supports 15,20 are in the preferred embodiment made of common two inch width lumber and are tied together by a vertical support located between the top and bottom horizontal supports 15, 20 and the fence 5 fastened to the top and bottom horizontal supports 15, 20. The top and bottom horizontal supports 15,20 are located spaced apart vertically to slidably accept the legs thickness X2 of the U-shaped seat 13 of the hanging support brackets 11. The top horizontal support 15 is engaged in the U-shaped seat 13 of each hanging support bracket 11. With this arrangement the hanging support brackets 11 can be moved somewhat along the length of the top horizontal support 15 as shown in FIG. 6 to coincide with an advantageous point of engagement to the top horizontal rail 7 of the fence 5

Figure 2:
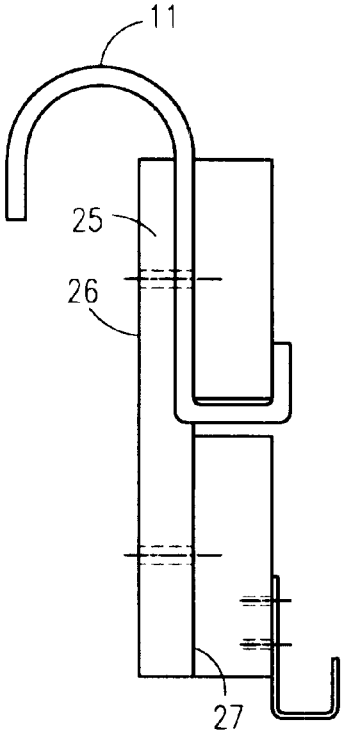
FIG. 2 is a side elevational view thereof.
Figure 3:
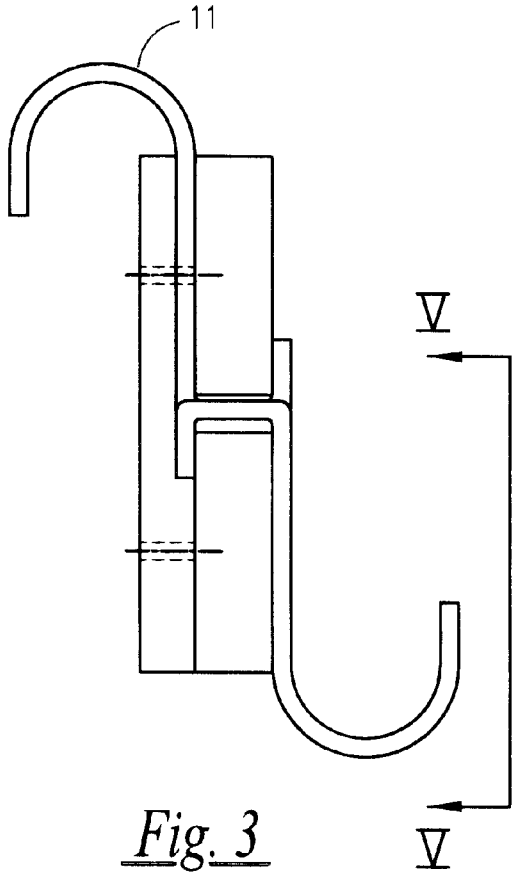
FIG. 3 is a side elevational view of a first alternate embodiment.

The vertical support 25 is made of common wood lumber and has a fence side 26 and a joint side 27 as shown in FIG. 2 and has holes 28 drilled in to accept screws or nails. The vertical support fence side 26 makes pivotal contact with the vertical rails 6 or the chain link lattice 8 of the fence 5. The vertical support 25 lumber thickness is specified based upon the desired angular position of the article holder 30. The joint side of the vertical support makes planar contact with the top horizontal support 15 and the bottom horizontal support 20. Screws or nails are used to fasten the vertical support 25 to the top and bottom horizontal supports 15,20.

The article holder 30 has a U-shaped support structure 31 for engaging items hung on to it. At one end the article holder has two or more mounting holes 32. The article holder 30 is fixedly attached with nails or screws to the exposed side of the bottom horizontal support 20 through the mounting holes 32.

2. Operation of the Preferred Embodiment

In operation, the present invention would be used in pairs. The invention is also envisioned to have other applications as well such as hanging hoses, potted plants, gardening tools and supplies, pool tools or toys, and the like enivisioned that other smaller versions of the invention could be used for similar applications such as on the side bed rail of a hospital bed for holding personal items or medical supplies, or on the inside of a car door for holding fast food or electronic devices.

Figure 5:
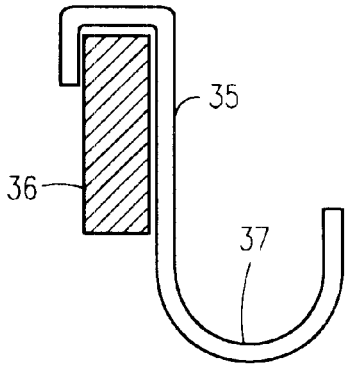
FIG. 5 is a partial cross sectional elevational view taken along line V—V of FIG. 3.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. By way of example, and not as a limitation, in a kit embodiment of the invention the hanging support brackets 11 can be purchased as commonly available joist hanger brackets 35. Joist hanger brackets 35 are sized to hang over two inch nominal width lumber joists 36 and provide a U-shaped hook 37 for hanging articles as shown in FIG. 5. In another form of the invention, a kit can be sold for constructing the entire article holder particularly adapted for being supported by a fence 10. In the kit one would receive three joist hanger brackets 35. Also the kit would have instructions and plans for making the top and bottom horizontal supports 15, 20 and the vertical support 25. With the provided hardware, the instructions, some nails and some two inch nominal width lumber one can easily construct this invention.

The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents. Therefore, the scope of the invention is to be limited only by the following claims.

What is claimed is:

1. An article holder particularly adapted for being supported by a fence, said article holder comprising:

a plurality of hanging support brackets, each of said hanging support brackets terminating at two ends, an upper end having an inverted U shape support structure forming an engaging top portion for securement about a top horizontal surface of a fence, and a lower end having a sharply bent U-shaped seat;

a top horizontal support slidably supported by said hanging support brackets, said top horizontal support resting within said U-shaped seat;

a bottom horizontal support;

a vertical support connecting said top horizontal support to said bottom horizontal support, said vertical support substantially aligned along a center of said top horizontal support and said bottom horizontal support; and an impingement support connected to said bottom horizontal support, said impingement support suspending objects therefrom for storage.

2. The article holder of claim 1, wherein an effective width of said U-shaped seat accommodates a nominal two inch lumber width.

3. The article holder of claim 2, wherein said top horizontal support is made of common two inch width lumber.

4. The article holder of claim 2, wherein said bottom horizontal support is made of common two inch width lumber.

5. The article holder of claim 1, wherein said top horizontal support and said bottom horizontal support are aligned in a coplanar arrangement about said vertical support and vertically spaced apart to slidably accept said U-shaped seat of said hanging support brackets, wherein the vertical spacing between said top horizontal support and said bottom horizontal support is slightly larger than a thickness of said U-shaped seat to permit placement of at least one of said hanging support brackets.

6. The article holder of claim 1, wherein said vertical support is made of common wood lumber, wherein said vertical support comprises a fence side and a joint side, said fence side opposite said joint side, said vertical support further comprising holes formed therethrough to accept screws or nails, said vertical support having a thickness for providing a specified angular position between said holder and the object said holder is secured to, said angular position being substantially vertical.

7. An article holder particularly adapted for being supported by a fence, said article holder comprising:

a plurality of hanging support brackets, each of said hanging support brackets having an inverted U shape support structure forming an engaging top portion for securement about a top horizontal surface of a fence, said U shaped support structure terminating at a sharply bent U-shaped seat;

a top horizontal support slidably supported by said hanging support brackets, wherein said top horizontal support is gravitationally impinged within said hanging support brackets;

a bottom horizontal support;

a vertical support connecting said top horizontal support to said bottom horizontal support, said vertical support substantially aligned along a center of said top horizontal support and said bottom horizontal support; and an impingement support connected to said bottom horizontal support, said impingement support comprising a linearly elongated vertical member affixed to said bottom horizontal support, a perpendicularly depending base, and a vertically projecting lip perpendicularly depending from said base, said impingement support for suspending objects placed thereon.

8. The article holder of claim 7, wherein said top horizontal support and said bottom horizontal support are aligned in a coplanar arrangement about said vertical support and vertically spaced apart to slidably accept said U-shaped seat of said hanging support brackets, wherein the vertical spacing between said top horizontal support and said bottom horizontal support is slightly larger than a thickness of said U-shaped seat to permit placement of at least one of said hanging support brackets.

9. The article holder of claim 7, wherein said vertical support is made of common wood lumber, wherein said vertical support comprises a fence side and a joint side, said fence side opposite said joint side, said vertical support further comprising holes formed therethrough to accept screws or nails, said vertical support having a thickness for providing a specified angular position between said holder and the object said holder is secured to, said annular position being substantially vertical.

* * * * *